US006905106B2

(12) United States Patent
Myers et al.

(10) Patent No.: US 6,905,106 B2
(45) Date of Patent: Jun. 14, 2005

(54) TAPERED PIN FOR POURED CONCRETE WALL FORM PANELS

(75) Inventors: Dallas E. Myers, Middletown, OH (US); James W. Jackson, Middletown, OH (US)

(73) Assignee: Featherlite Innovations, Inc., Springboro, OH (US)

( * ) Notice: Subject to any disclaimer, the term of this patent is extended or adjusted under 35 U.S.C. 154(b) by 0 days.

(21) Appl. No.: 10/698,288

(22) Filed: Oct. 31, 2003

(65) Prior Publication Data

US 2004/0089787 A1 May 13, 2004

Related U.S. Application Data

(62) Division of application No. 09/892,050, filed on Jun. 26, 2001, now Pat. No. 6,691,976.

(60) Provisional application No. 60/214,338, filed on Jun. 27, 2000.

(51) Int. Cl.[7] ..... E04G 17/00

(52) U.S. Cl. ..... 249/191; 249/196; 411/355

(58) Field of Search ..... 411/351, 354, 411/355, 356, 500; 249/44, 45, 47, 191, 192, 193, 194, 195, 196

(56) References Cited

U.S. PATENT DOCUMENTS

| | | | |
|---|---|---|---|
| 1,621,563 | A | 3/1927 | Stevens |
| 1,641,927 | A | 9/1927 | Gremel |
| 2,677,868 | A | 5/1954 | Banneyer |
| 2,693,627 | A | 11/1954 | Banneyer |
| 2,763,911 | A | 9/1956 | Rumble |
| 2,871,619 | A | 2/1959 | Walters |
| 3,010,175 | A | 11/1961 | Shoemaker |
| 3,055,076 | A | 9/1962 | Van Helden et al. |
| 3,204,918 | A | 9/1965 | Bonin et al. |
| 3,211,413 | A | 10/1965 | Low III |
| 3,327,986 | A | 6/1967 | Oury |
| 3,362,676 | A | 1/1968 | Bowden |
| 3,432,137 | A | 3/1969 | Krajco |
| 3,447,771 | A | 6/1969 | Trimmer |
| 3,529,800 | A | 9/1970 | Gates |
| 3,862,737 | A | 1/1975 | Fuston, Jr. |
| 3,877,674 | A | 4/1975 | Cerutti |
| 3,972,501 | A | 8/1976 | Plough |
| 3,981,476 | A | 9/1976 | Alexander et al. |
| 3,984,079 | A | 10/1976 | Gates |
| 4,030,694 | A | 6/1977 | Schimmel |
| 4,068,818 | A | 1/1978 | Gates |
| 4,158,452 | A | 6/1979 | Gates |
| 4,194,717 | A | 3/1980 | Easton et al. |
| 4,210,305 | A | 7/1980 | Williams |
| 4,211,385 | A | 7/1980 | Johanson et al. |
| 4,239,173 | A | 12/1980 | Sawyer |
| 4,280,677 | A | 7/1981 | Shahar |
| 4,417,425 | A | 11/1983 | Case et al. |
| 4,473,209 | A | 9/1984 | Gallis et al. |
| 4,821,995 | A | 4/1989 | Merkel |
| 4,881,716 | A | 11/1989 | Dingler |
| D312,201 | S | 11/1990 | Gates |
| 4,975,009 | A | 12/1990 | Easton et al. |
| 5,058,855 | A | 10/1991 | Ward |
| 5,078,360 | A | 1/1992 | Spera |
| 5,174,909 | A | 12/1992 | Ward |
| 5,251,868 | A | 10/1993 | Trimmer et al. |
| 5,265,836 | A | 11/1993 | Dale |
| 5,288,051 | A | 2/1994 | Ward |
| 5,744,076 | A | 4/1998 | Baxter |
| 5,759,429 | A | 6/1998 | Trimmer et al. |
| 5,802,795 | A | 9/1998 | Myers et al. |
| 5,827,442 | A | 10/1998 | Wicker et al. |
| 5,852,907 | A | 12/1998 | Tobin et al. |
| 5,968,403 | A | 10/1999 | Myers et al. |

*Primary Examiner*—Michael Safavi
(74) *Attorney, Agent, or Firm*—Wood, Herron & Evans, LLP

(57) ABSTRACT

A pin and wedge combination to couple adjacent panels of a concrete wall form together includes a pin with a tapered region along its shank to assist in removal of the pin from the hole in the flange of the panel and the tie-rod during disassembly of a concrete wall form.

20 Claims, 2 Drawing Sheets

TAPERED PIN FOR POURED CONCRETE WALL FORM PANELS

This is a divisional of U.S. patent application Ser. No. 09/892,050, filed Jun. 26, 2001, now U.S. Pat. No. 6,691, 976, which in turn claimed the benefit of U.S. Provisional Patent Application Ser. No. 60/214,338, filed Jun. 27, 2000, each of which is hereby incorporated by reference in its entirety.

BACKGROUND OF THE INVENTION

This invention relates to poured concrete wall forms, and more particularly, to connecting hardware for panels coupled together and used to construct the concrete wall form.

It is well known in the art to use prefabricated reusable panel units to construct a wall form for a poured concrete wall. The hardware associated with such panels connects the panels to one another to form the wall form.

Typically, each panel has a marginal frame projecting rearwardly from a back face of the panel to include a flange along the spaced side edges of the panel. The flanges are adapted to be positioned in an edge to edge relationship with the flange of an adjacent panel to construct a concrete wall form. Holes in the flanges of the adjacent panels can be aligned to receive therethrough the shank of a pin or a bolt. The bolt or pin may pass through the ends of tie-rods and are held in position commonly by wedges which are driven though a slot in the shank of the bolt or pin. As the wedges are driven in place, the abutting flanges of the adjacent panel units are drawn together. The pins and wedges constitute a simple mechanism for effectively coupling the panels together. The pins and wedges can be removed from the panels during the dismantling of the wall form by knocking out the wedges from the slots and sliding the pins from their holes to release the adjacent panel units and the pin from the tie-rod now embedded in the cured concrete.

In the construction of a concrete wall form, a large quantity of hardware is necessary to connect the numerous panels together. Each pair of adjacent panels is typically connected together by multiple, typically three to four, pin and wedge combinations. After the spaced wall forms are constructed and the concrete poured, the panels and pins attaching the panels experience significant hydrodynamic forces resulting from the pouring and curing of the concrete. The large forces experienced by the pins often make it difficult to remove the pins from the flanges of the adjacent panels once the concrete is cured. Commonly, a hammer or other tool is required to dislodge the wedge from the pin and to dislodge the pin from the flanges of the adjacent panels.

One of the primary purposes of the tie rods extending between the spaced wall forms is to maintain the position of the wall forms relative to one another during the pouring and curing of the concrete. As a result, the tie rods exert a significant amount of force on the pins they are attached to in order to hold the panels in place during the concrete pouring and curing. Therefore, the pins are often very difficult to remove from the flanges and to release from the attached tie rods.

Furthermore, the wall forms are commonly constructed in excavated areas such as ditches and trenches when preparing the wall form for a poured concrete wall in a residential basement or below ground floor of a commercial building. As such, the work space for constructing and disassembling the wall form and for the workers to maneuver and manipulate the associated hardware is extremely tight and limited. Therefore, the installation and removal of the pins and wedges is even more difficult and problematic.

Therefore, a need exists in the industry for an attachment mechanism for coupling adjacent panels and constructing a poured concrete wall form which is easily and conveniently installed and most importantly disassembled by the workers in the field. Such an attachment segment must be robust enough to withstand the concrete forces, economical to manufacture and preferably be compatible with existing wall form panels.

SUMMARY OF THE INVENTION

These and other objectives of the invention have been attained by an improved pin for coupling adjacent panels together to form a concrete wall form. The pin according to a presently preferred embodiment of this invention is adapted to be used with a wedge as is well known in the art. The wedge typically has a tapered configuration such that a broad end of the wedge tapers to a more narrow end of the wedge. The pin has an enlarged head and an elongated shank extending from the head to a rounded tip or blunt end opposite the head. A generally rectangular through slot to receive the wedge is included in the shank proximate the end and extends perpendicularly to a longitudinal axis of the pin.

Advantageously, the pin according to this invention includes a tapered region to facilitate the removal of the pin from the tie rod and flanges of the adjacent panels during disassembly of the wall forms after the concrete has cured. In certain embodiments of this invention, the tapered region includes two portions. A first portion proximate the head of the pin tapers from a large diameter adjacent the head toward a smaller diameter at a juncture with a second tapered portion. The diameter of the second tapered portion at the juncture is greater than the diameter of the pin proximate the tip end. As a result of the tapered region and other features of the pin according to this invention, once the wedge is removed from the slot, the removal of the pin is easier than with known pin designs because of the tapered region. The taper on the shank of the pin promotes the release of the pin from the holes in the flanges of the panels and the removal of the shank of the pin from the hole in the tie rod. Because of the tapered region, movement of the pin from a larger diameter or circumferential portion of the shank toward a smaller diameter or circumferential portion is advantageously easier than the purely cylindrical-shaped, non-tapered shank of known pins.

In constructing the wall form using the pin and wedge combination according to this invention, adjacent panels are positioned with the associated holes in adjacent flanges being aligned so that the pin can be inserted through the first flange until the head contacts one of the flanges. A tie-rod is slipped onto the pin and the adjacent panel is joined by inserting the narrow end of the wedge into the slot to secure the pin in the holes and releasably couple the panels together.

As a result, the pin according to this invention provides a simple and cost effective attachment mechanism to facilitate easier removal of the present pin compared to previously known pins. The pin and wedge combination of this invention can be used with currently existing panel designs utilizing existing wedges without replacing an entire inventory of hardware and is robust to withstand the concrete pouring and curing forces while still being more easily removed than known pin designs.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
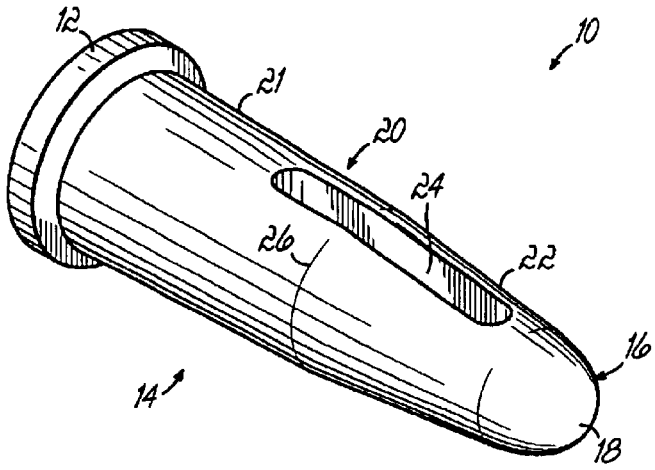
FIG. 1 is a perspective view of one embodiment of a pin according to this invention.
Figure 2:
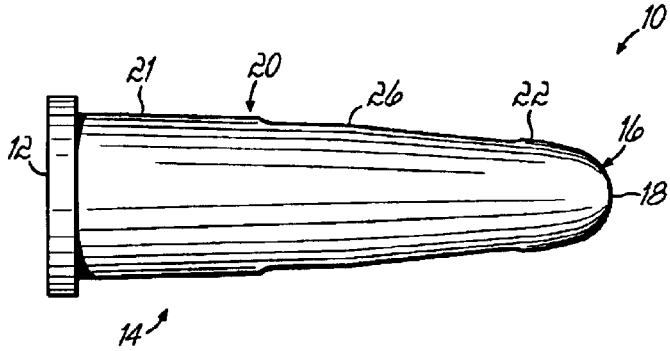
FIG. 2 is a side elevational view of the pin of FIG. 1.
Figure 3:
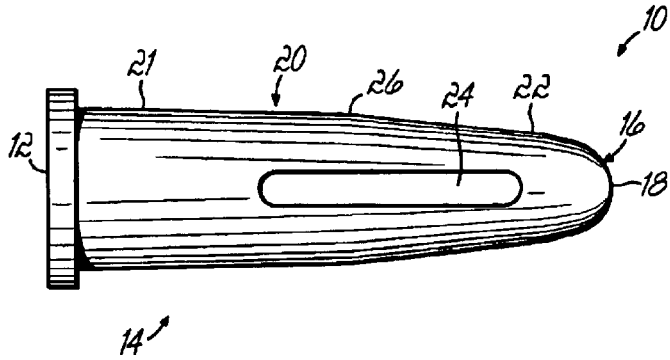
FIG. 3 is a top plan view of the pin of FIG. 1 with the bottom view being a mirror image thereof.
Figure 4:
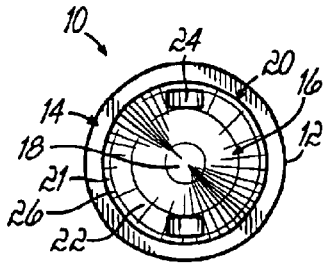
FIG. 4 is a right side view of the pin of FIG. 1.

Referring to FIG. 1, a presently preferred embodiment of a pin 10 according to this invention is shown. The pin 10 includes an enlarged disk shaped head 12 and an elongated shank 14 extending from the head 12. A rounded end 16 opposite the head 12 terminates in a blunt tip 18. The shank 14 includes a tapered region 20 which in one embodiment includes a first portion 21 adjacent the head 12 and a second portion 22 adjacent the tip end 16. The first and second portions meet at a juncture 26. The pin 10 also includes a generally oval through slot 24 in the shank 14 proximate the end 16 and extending perpendicularly to a longitudinal axis of the pin 10.

Figure 6:
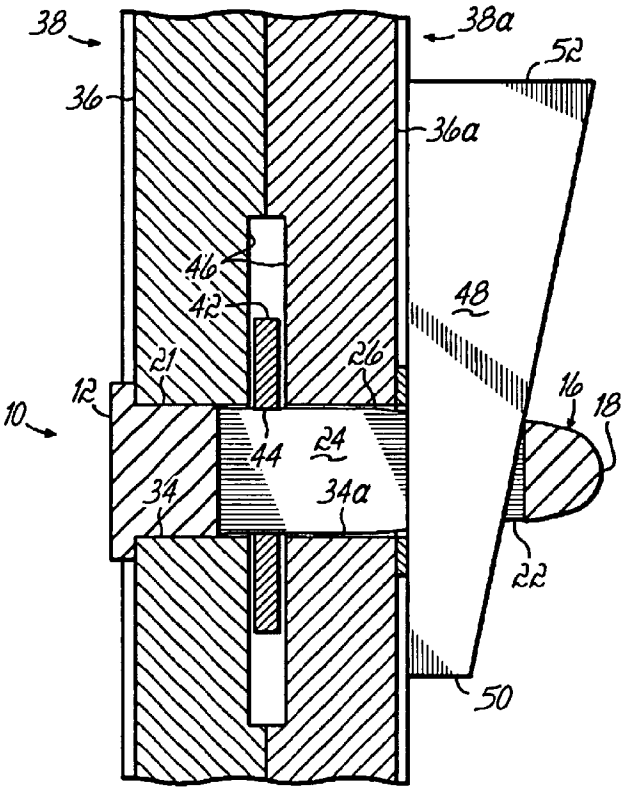
FIG. 6 is a cross-sectional view of the assembled hardware, including the pin, according to this invention, securing adjacent wall form panels together.
Figure 5:
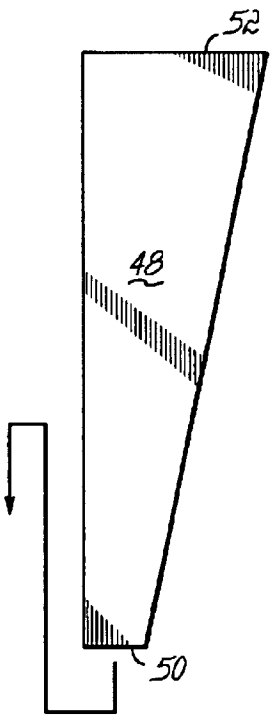
FIG. 5 is a cross-sectional view of a pin according to this invention being assembled with a tie rod, wall form panels and wedge for constructing a concrete wall form.
Figure 5:
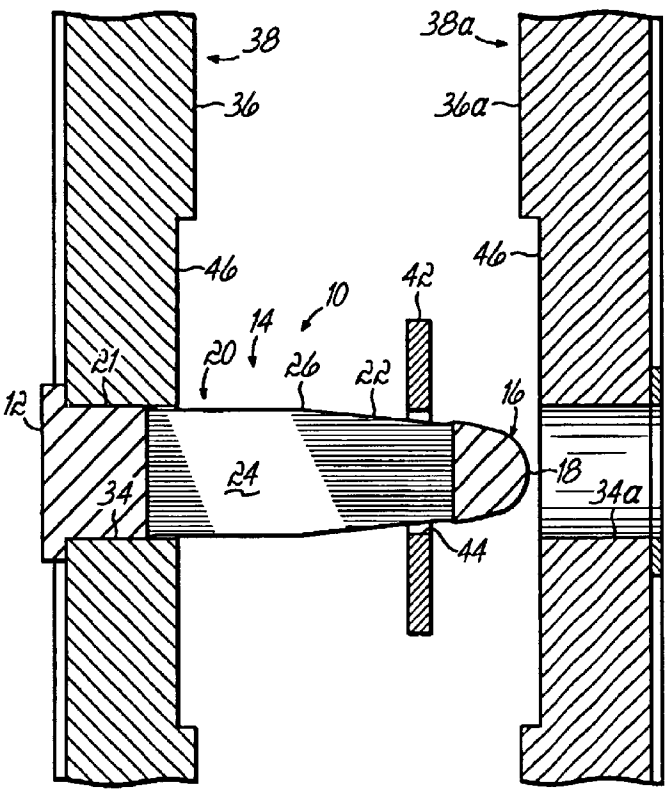

Referring to FIGS. 5 and 6, the shank 14 of the pin 10 is sized for insertion through a hole 34 in a flange 36 of a panel 38 used for constructing a concrete wall form. The hole 34 in the flange 36 is aligned with a similarly configured hole 34*a* in the flange 36*a* of an adjacent panel 38*a*. The flanges 36, 36*a* may include a bushing (not shown) seated in the holes 34, 34*a* and the diameter of the opening in the bushing is less than the diameter of the disk shaped head 12 on the pin 10 thereby preventing the head 12 from passing through the holes 34, 34*a* in the flanges 36, 36*a*.

As is well known in the art, a tie-rod 42 having hole 44 proximate an end thereof is positioned between the panels 38, 38*a* of the concrete wall form to maintain the spacing between opposed panels (not shown) forming a cooperating wall form (not shown). The flanges 36, 36*a* may include a notch or cut-out 46 sized and configured to accommodate the tie-rod 42 seated therein so that the flanges 36, 36*a* of the adjacent panels 38, 38*a* can be juxtaposed in face to face abutting relationship.

A wedge 48 according to a presently preferred embodiment of this invention is well known in the art and includes a generally planar piece of steel or other appropriate metal which is dimensioned to fit within the slot 24 in the pin 10. The wedge 48 has a tapered configuration so that a narrow end 50 of the wedge 48 passes into and through the slot 24 and a broad end 52 of the wedge 48 is wider than the slot 24 and is thereby prevented from passing through the slot 24. One presently preferred embodiment of a wedge 48 which could be used in this invention is disclosed in U.S. Provisional Patent Application Ser. No. 60/035,666 filed Jan. 21, 1997, which is hereby incorporated by reference. In assembling a concrete wall form according to this invention, the adjacent panels 38, 38*a* are positioned with the respective holes 34, 34*a* in the flanges 36, 36*a* being generally aligned and the flanges 36, 36*a* initially being spaced. The pin 10 is inserted into the hole 34 in the flange 36 by the worker so that the head 12 contacts the bushing and is prevented from passing through the hole 34 as shown in FIGS. 5–6.

After the pin 10 is inserted in the flange 36 and the tie-rod 42 is fitted over the shank 14 of the pin 10, the adjacent panel 38*a* is moved into abutting relationship with the panel 38 so that the shank 14 of the pin 10 projects through the aligned hole 34*a*. The pin 10 may be retained in position during assembly of the wall form by a spring biased ball (not shown) as disclosed in U.S. Pat. No. 5,802,795 which is assigned to the assignee of this invention and hereby incorporated by reference entirely. Lastly, the narrow end 50 of the wedge 48 is inserted into the slot 24 and hammered or forced into place thereby releasably coupling and binding the adjacent panels 38, 38*a* and tie-rod 42 together and forming the concrete wall form. Disassembly of the wall form is easily accomplished according to this invention by dislodging the wedge 48 from the slot 24 and pushing the pin 10 out of the holes 34, 34*a*.

The tapered region 20 on the pin 10 assists in the easy removal of the pin 10 from the holes 34, 34*a*. The forces exerted on the panels 38, 38*a* by the poured concrete often make it difficult to extract known pin designs from the holes 34, 34*a*. Due to the slope of the tapered region 20, the binding forces generated by the concrete acting on the pin 10 are more quickly relieved as the pin 10 is withdrawn.

In one presently preferred embodiment of this invention, the pin 10 is 4140 steel finished with a black oxide having a Rockwell C hardness of 40–45. The head 12 of the pin 10 has a diameter of approximately 0.87 inches and the diameter of the shank 14 adjacent the head 12 is approximately 0.65 inches. The overall length of the pin 10 is preferably about 2.45 inches and the through slot 24 measures approximately 0.165 inches by 1.0625 inches in a generally oval configuration with a radius of about 0.083 inches at each end of the slot 24. The end of the slot 24 adjacent the head 12 is spaced approximately 0.781 inches from the head 12.

In one embodiment, the tapered region 20 extends a substantial portion of the length of the shank 14. In a further embodiment, the tapered region 20 includes the first and second portions 21, 22. The first portion 21 begins adjacent the head 12 and extends approximately 1.185 inches. The taper of the first portion 21 is relatively slight and preferably on the order of 0.65 inches to 0.63 inches. The taper of the second portion 22 is more significant and is on the order of 0.125 inches preferably. Generally, it is advantageous to have the tie-rod 42 seated on the tapered region 20 of the shank 14 of the pin 10 (FIG. 6) to facilitate the removal of the tie-rod 42. The tapered region 20 promotes the withdraw of the pin 10 from the hole 44 of the tie-rod 42 and, likewise, the withdraw of the pin 10 from the holes 34, 34*a* in the flanges 36, 36*a* of the adjacent wall form panels.

While presently preferred embodiments of the pin 10 are shown with the tapered region 20 extending the entire length of the shank 14, it is within the scope of this invention that the tapered region extends only a portion of the shank while still providing the above-described benefits. Moreover, the embodiments disclosed herein reveal that the tapered region of the shank extends entirely around the circumference of the pin while other arrangements and pin designs are well within the scope of this invention in which the tapered region extends over only a portion of the circumferential region of the shank of the pin. Moreover, while pins are commonly used with wedges in the industry, embodiments of the pin shown herein include a slot to accommodate a wedge; whereas, alternative pin designs are readily encompassed within the scope of this invention which do not use a wedge for securing the pin during assembly of the wall form. These and other additional embodiments are likewise encompassed within the scope of this invention.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A combination comprising:

a pair of panels for use in constructing a poured concrete structure, each of the panels having a flange extending from a face of the panel, each flange having at least one aperture formed therethrough;

a pin having an enlarged head and an elongated shank extending between the head and an end of the pin, the shank having a through slot spaced from the head;

a tapered region on the shank of the pin, the tapered region extending from the end of the pin to include at least a portion of the through slot;

wherein the tapered region further comprises a first portion and a second portion each extending axially on the shank of the pin, a slope of the first portion being different than a slope of the second portion of the tapered region; and a wedge having a first end which is larger than a second end thereof, the second end being sized to pass through the through slot and the first end being sized not to pass through the through slot;

wherein the end of the pin is inserted into and through the apertures in the flanges of the panels and the head preventing the pin from passing entirely through the apertures, the flanges of the panels being juxtaposed to one another and the second end of the wedge inserted into and through the through slot to releasably couple the panels together and the tapered region facilitating removal of the pin from the apertures after the wedge is withdrawn from the slot;

wherein a juncture between the first and second portions intersects the through slot.

2. The combination of claim 1 wherein the tapered region extends over a substantial portion of the length of the shank.

3. The combination of claim 1 wherein the slope of the first portion is greater than the slope of the second portion and the first portion is proximate the end of the pin and the second portion is proximate the head of the pin.

4. The combination of claim 1 wherein a cross section of the shank is generally circular.

5. The combination of claim 4 wherein the tapered region extends around an entire circumference of the shank of the pin.

6. The combination of claim 1 further comprising:

a tie-rod positioned between the flanges of the concrete wall form panels, the tie-rod having a hole through which the shank of the pin is inserted, the tie-rod being positioned on the tapered region of the shank when positioned between the flanges and the pin is inserted through the hole.

7. A combination for connecting a first concrete wall form panel to a second concrete wall form panel wherein the first panel has a first flange extending outwardly therefrom and a first aperture formed therethrough, the second panel has a second flange extending outwardly therefrom and a second aperture formed therethrough which is aligned with the first aperture, the combination comprising:

a pin having an enlarged head and an elongated shank extending between the head and an end of the pin, the shank having a through slot spaced from the head;

a tapered region on the shank of the pin, the tapered region extending from the end of the pin to include at least a portion of the through slot;

wherein the tapered region further comprises a first portion and a second portion each extending axially on the shank of the pin, a slope of the first portion being different than a slope of the second portion of the tapered region; and a wedge having a first end which is larger than a second end thereof, the second end being sized to pass through the through slot and the first end being sized not to pass through the through slot;

wherein the end of the pin is adapted to be inserted into and through the apertures in the flanges on the panels and the head preventing the pin from passing entirely through the apertures, the flanges of the panels being juxtaposed to one another and the second end of the wedge inserted into and through the through slot to releasably couple the panels together and the tapered region facilitating removal of the pin from the apertures after the wedge is withdrawn from the slot;

wherein a juncture between the first and second portions intersects the through slot.

8. The combination of claim 7 wherein the tapered region extends over a substantial portion of the length of the shank.

9. The combination of claim 7 wherein the slope of the first portion is greater than the slope of the second portion and the first portion is proximate the end of the pin and the second portion is proximate the head of the pin.

10. The combination of claim 7 wherein a cross section of the shank is generally circular.

11. The combination of claim 10 wherein the tapered region extends around an entire circumference of the shank of the pin.

12. A pin for connecting a first concrete wall form panel to a second concrete wall form panel wherein the first panel has a first flange extending outwardly therefrom and a first aperture formed therethrough, the second panel has a second flange extending outwardly therefrom and a second aperture formed therethrough which is aligned with the first aperture, the pin comprising:

an enlarged head;

an elongated shank extending between the head and an end of the pin;

a through slot in the shank and spaced from the head; and a tapered region on the shank extending from the end of the pin to include at least a portion of the through slot;

wherein the tapered region further comprises a first portion and a second portion each extending axially on the shaft of the pin, a slope of the first portion being different than a slope of the second portion of the tapered region;

wherein the end of the pin is adapted to be inserted into and through the apertures in the flanges on the panels and the head preventing the pin from passing entirely through the apertures, the flanges at the panels being juxtaposed to one another and the tapered region facilitating removal of the pin from the apertures;

wherein a juncture between the first and second portions intersects the through slot.

13. The pin of claim 12 wherein the tapered region extends over a substantial portion of the length of the shank.

14. The pin of claim 12 wherein the slope of the first portion is greater than the slope of the second portion and the first portion is proximate the end of the pin and the second portion is proximate the head of the pin.

15. The pin of claim 12 wherein a cross section of the shank is generally circular.

16. The pin of claim 12 wherein the tapered region extends around an entire circumference of the shank of the pin.

17. A method for assembling a concrete form for constructing a poured concrete structure, the method comprising the steps of:

positioning a first and a second panel relative to one another with a first flange on the first panel confronting a second flange on the second panel;

aligning a first hole in the first flange with a second hole in the second flange;

inserting an end of a pin and a slot in a shank of the pin through the first and second holes, the shank of the pin including a first and a second tapered region, the tapered regions meeting at a juncture intersecting the slot; and inserting a first end of a wedge through the slot until the first and second flanges are coupled to one another thereby releasably coupling the panels together.

18. The method of claim 17 further comprising:

positioning a tie-rod between the first and second flanges;

aligning a hole in the tie-rod with the first and second holes in the first and second flanges; and inserting the pin through the tie-rod hole;

wherein removal of the pin from the first and second holes and the tie-rod hole is facilitated by the tapered region on the shank of the pin.

19. The method of claim 18 further comprising:

positioning the tie-rod on the tapered region of the shank of the pin.

20. A pin for connecting a first concrete wall form panel to a second concrete wall form panel wherein the first panel has a first flange extending outwardly therefrom and a first aperture formed therethrough, the second panel has a second flange extending outwardly therefrom and a second aperture formed therethrough which is aligned with the first aperture, the pin comprising:

an enlarged head;

an elongated shank extending between the head and an end of the pin, the end of the pin being rounded;

a through slot in the shank; and a tapered region on the shank extending a substantial portion of the shank;

wherein the tapered region further comprises a first portion and a second portion each extending axially on the shank of the pin, a slope of the first portion being different than a slope of the second portion of the tapered region;

a juncture between the first and second portions intersecting the through slot;

wherein the end of the pin is adapted to be inserted into and through the apertures in the flanges on the panels and the head preventing the pin from passing entirely through the apertures, the flanges of the panels being juxtaposed to one another and the tapered region facilitating removal of the pin from the apertures.

* * * * *